US011313129B1

(12) United States Patent
Gray et al.

(10) Patent No.: US 11,313,129 B1
(45) Date of Patent: Apr. 26, 2022

(54) ROOF VENT ASSEMBLY

(71) Applicants: Paul A. Gray, Kent, OH (US); Jesse Gray, Kent, OH (US)

(72) Inventors: Paul A. Gray, Kent, OH (US); Jesse Gray, Kent, OH (US)

( * ) Notice: Subject to any disclaimer, the term of this patent is extended or adjusted under 35 U.S.C. 154(b) by 75 days.

(21) Appl. No.: 16/799,405

(22) Filed: Feb. 24, 2020

Related U.S. Application Data

(63) Continuation-in-part of application No. 15/611,641, filed on Jun. 1, 2017, now Pat. No. 10,571,141.

(60) Provisional application No. 62/392,450, filed on Jun. 2, 2016.

(51) Int. Cl.
*E04D 13/143* (2006.01)
*E04D 13/17* (2006.01)
*E04D 11/02* (2006.01)

(52) U.S. Cl.
CPC ..... *E04D 13/17* (2013.01); *E04D 11/02* (2013.01)

(58) Field of Classification Search
CPC ..... F24F 7/00; F24F 7/02; F24F 7/025; F24F 7/04; F24F 7/06; F24F 7/065; F24F 2221/16; E04D 13/17; E04D 13/174
USPC ..... 454/242, 250, 365, 366; 55/199
See application file for complete search history.

(56) References Cited

U.S. PATENT DOCUMENTS 3,685,426 A 8/1972 Rosa
3,984,947 A 10/1976 Patry
4,432,273 A 2/1984 Devitt
4,484,424 A 11/1984 Logsdon
4,593,504 A 6/1986 Bonnici et al.
4,909,135 A 3/1990 Greko
5,193,390 A * 3/1993 Nill, Jr. ..... G01M 3/16 73/335.02
5,213,542 A * 5/1993 Kelly ..... E04D 13/17 454/357
5,724,777 A * 3/1998 Hubbard ..... E04D 13/0409 210/163
6,040,775 A 3/2000 Nill, Jr.
6,225,909 B1 * 5/2001 Nill, Jr. ..... E04D 13/006 340/602
9,228,689 B1 * 1/2016 Cline ..... E04D 13/1476
9,267,699 B1 * 2/2016 Souza ..... E03F 5/08
2006/0005479 A1 * 1/2006 Jones ..... E04D 13/17 52/199
2011/0302876 A1 * 12/2011 Giffin ..... F24F 7/02 52/741.4
2013/0174502 A1 * 7/2013 Rodriguez, Jr. .... E04D 13/1471 52/219
2014/0020313 A1 * 1/2014 Preston, III ..... E04D 13/172 52/199
2014/0106661 A1 * 4/2014 Baldwin ..... F24F 13/14 454/358

(Continued)

*Primary Examiner* — Vivek K Shirsat
*Assistant Examiner* — Ko-Wei Lin
(74) *Attorney, Agent, or Firm* — Timothy D. Bennett; Emerson Thomson Bennett, LLC

(57) ABSTRACT

A roof vent assembly may include a vent tube, a vent cap, an air plate and one or more airflow extension members. The airflow extension members may extend outward beyond the periphery of the air plate to create external air plenums. The roof vent assembly may be operable to draw air from the external air plenums under a roof membrane, into an internal air plenum defined by the air plate, through the vent tube and out of the vent cap to remove moisture from the roof.

19 Claims, 11 Drawing Sheets

(56) References Cited

U.S. PATENT DOCUMENTS

2016/0040898 A1* 2/2016 Lipinski ..... E04D 13/17
454/242

* cited by examiner

ROOF VENT ASSEMBLY

This application is a continuation-in-part of U.S. patent application Ser. No. 15/611,641, entitled ROOF MOISTURE DETECTION AND REMOVAL SYSTEM, filed Jun. 1, 2017, which claims priority from U.S. Ser. No. 62/392,450, entitled ROOF MOISTURE VENT WITH WIRELESS NOTIFICATION, filed Jun. 2, 2016, both of which are incorporated herein by reference.

FIELD OF THE INVENTION

The present invention relates generally to roofing apparatus, more specifically but not by way of limitation, roof vent that is configured to provide moisture detection for an area of a roof adjacent thereto and further facilitate the removal of at least a portion of the moisture.

BACKGROUND

Millions of commercial and industrial structures utilize conventional flat roof systems. By way of example but not limitation, structures such as warehouses and office buildings are routinely designed with roofs that have little to no slope. These conventional roofs are typically constructed having layers such as but not limited to a deck structure having an insulation material, a vapor barrier, an additional layer of roofing material and a moisture membrane. The aforementioned construction generally provides a watertight roof system but these systems have been shown to fail either due to damage, age or poor workmanship. One problem with these types of roof structures is that ensuing a development of a leak moisture becomes trapped between the layers of the roof where it can remain undetected causing significant damage.

Existing technology utilizes roof vents that are installed across the roof structure and function to allow trapped moisture to escape from the roof structure if present. While current technology has shown to be somewhat effective there are limitations to the existing technology. Existing roof vent technology can be limited as to what type of roof membrane material to which they can be installed and the amount of moisture that they can eliminate due to inherent low air volume. Existing roof vent systems having moisture detection typically require physical contact with the moisture for detection thereof which leads to component failure. Current roof vents can require larger holes in the roof membrane for installation, which can be a problem during replacement or retrofit of an existing roof. Lastly, existing roof vents have reduced air intake plenum areas, which can lead to inefficient moisture reduction.

Accordingly, there is a need for a roof vent system that provides more efficient and proactive moisture detection and reduction for commercial roof structures.

SUMMARY OF THE INVENTION

It is the object of the present invention to provide a roof vent system that is configured to remove moisture from a commercial roof structure that includes a roof vent assembly operable to be installed on a roof.

Another object of the present invention is to provide a roof vent assembly that is configured to remove moisture trapped between layers of a roof structure wherein and air plate is coupled to one or more airflow extension members.

Still another object of the present invention is to provide a roof vent system that is configured to remove moisture trapped between layers of a roof structure wherein the roof vents further include a cap having a photovoltaic panel thereon.

An additional object of the present invention is to provide a roof vent system configured to detect moisture from a commercial roof structure wherein the roof vents include a detection module suspendedly mounted within the roof vent riser tube.

Yet a further object of the present invention is to provide a roof vent system that is configured to detect moisture trapped between layers of a roof structure wherein the roof vents further include a fan disposed above or within the roof vent riser tube.

Another object of the present invention is to provide a roof vent system configured to detect moisture from a commercial roof structure wherein the roof vents further include an infrared sensor mounted on the roof vent cap.

An alternative object of the present invention is to provide a roof vent system that is configured to detect moisture trapped between layers of a roof structure wherein the roof vents include detection modules and are operable to provide data wirelessly to a remote server or other computing device.

An additional object of the present invention is to provide a roof vent system configured to detect moisture from a commercial roof structure wherein each roof vent includes a communication module configured to transmit data.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
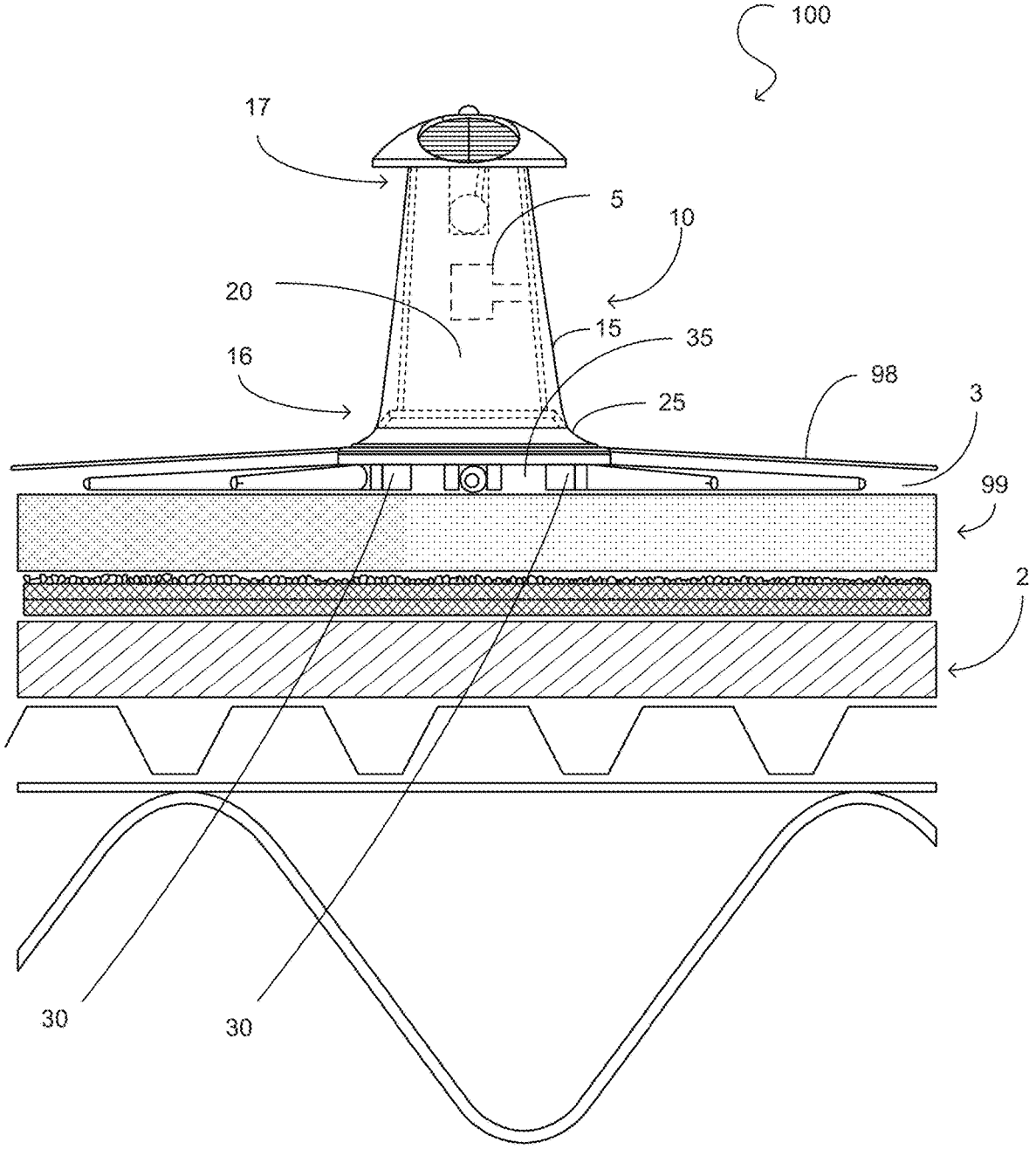
FIG. 1 is a cross-sectional of a roof vent of the present invention secured to an exemplary roof structure.

Referring now to the drawings submitted herewith, wherein various elements depicted therein are not necessarily drawn to scale and wherein through the views and figures like elements are referenced with identical reference numerals, there is illustrated an roof moisture detection and removal system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
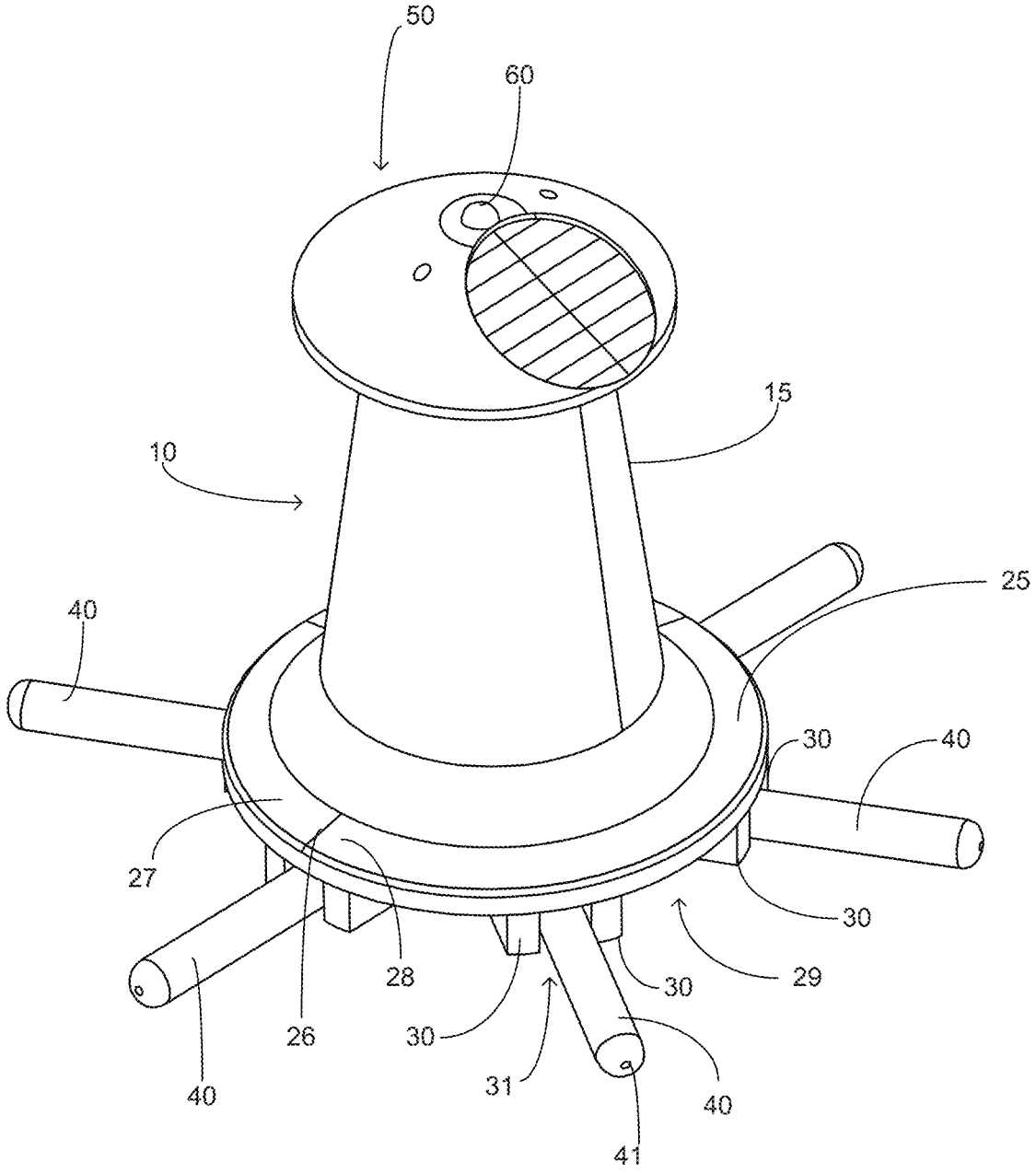
FIG. 2 is a perspective view of a roof vent of the present invention.

Referring in particular to FIGS. 1 and 2 herein the roof moisture detection and removal system 100 includes roof vent 10. The roof vent 10 includes roof vent riser tube 15 that is manufactured from a suitable durable material such as but not limited to metal. The roof vent riser tube 15 includes lower end 16 and upper end 17 and is cylindrical in shape with a slight taper towards the upper end 17. A hollow passage 20 is present within roof vent riser tube 10 and is configured to atmospherically couple the exemplary roof 99 with the environmental atmosphere in which the roof vent 10 is present so as to facilitate moisture removal as will be further discussed herein.

The roof vent 10 includes a base ring 25 that is configured to be circumferentially disposed around roof vent riser tube 15 proximate the lower end 16 thereof. The base ring 25 is constructed from a durable flexible material and functions to sealably couple the roof vent riser tube 10 with roof membrane 98. It should be understood by those skilled in the art that the base ring 25 is sealably coupled with roof membrane 98 utilizing suitable materials and/or techniques such as but not limited to caulking. The base ring 25 includes split seam 26 wherein the split seam 26 allows the base ring to be manipulated so as to be inserted into a smaller hole in roof membrane 98. The split seam 26 allows portions 27, 28 adjacent thereto to be separated in order to provide a user a technique to manipulate the shape of the base ring 25 temporarily so as to insert the base ring 25 into a hole in the roof membrane 98.

Secured to the bottom 29 of the base ring 25 are a plurality of airflow spacers 30. The airflow spacers 30 are secured to the bottom 29 utilizing suitable durable techniques. The airflow spacers 30 are provided in pairs having a gap 31 therebetween providing sufficient space for the airflow extension tubes 40 that will be further discussed herein. The airflow spacers 30 are rectangular blocks manufactured from a suitable durable material and function to increase the void 35 intermediate the lower end 16 of the riser vent tube 15 and the exemplary roof 99. The increased void 35 functions to provide a larger and improved internal air intake plenum that provides improved ventilation in order to effect more efficient moisture removal from exemplary roof 99. The airflow spacers 30 are dispersed radially on the bottom 29 of the base ring 25 and it is contemplated within the scope of the present invention that at least four pairs of airflow spacers 30 are equally distributed around base ring 25. It is further contemplated within the scope of the present invention that the base ring 25 could have numerous alternate quantities of airflow spacers 30 wherein alternate quantities could be greater or less than the amount defined herein. It should be further understood that the airflow spacers 30 could be manufactured in alternate shapes and/or sizes in order to accomplish the desired task stated herein.

Secured within the gap 31 of the airflow spacer 30 pairs are airflow extension tubes 40. Airflow extension tubes 40 are secured to the base ring 25 within gap 31 utilizing suitable durable techniques. It is also contemplated within the scope of the present invention that the airflow extension tubes 40 could be releasably positioned in gap 31. The airflow extension tubes 40 are manufactured from a suitable durable material and include a hollow passage 41 therethrough configured to provide airflow into void 35. The airflow extension tubes 40 provide a technique to increase the air intake into the roof vent 10 from an area of the exemplary roof 99 more distal than existing technology. The airflow extension tubes 40 are radially disposed along base ring 25 and extend outward therefrom. A combination of the airflow extension tubes 40 and airflow spacers 30 are used to provide an increased air intake plenum so as to improve the airflow through void 35 and as such provide improved moisture detection and removal from underneath the roof membrane 98 and roof 99. It is contemplated within the scope of the present invention that the roof vent 10 could include various quantities of airflow extension tubes 40. Further, it should be understood that the airflow extension tubes 40 could be manufactured in alternate diameters and length. The airflow spacers 30 and airflow extension tubes 40 create a larger void 35 and as such a larger air intake plenum. Conventional heating and cooling cycles of the roof 99 promotes condensation formation to occur in the void 35 and space 3 under roof membrane 98. As the temperature of the roof increases during daytime hours water present under roof membrane 98 is transitioned to its vapor state and is evacuated by the roof vent 10.

Figure 3:
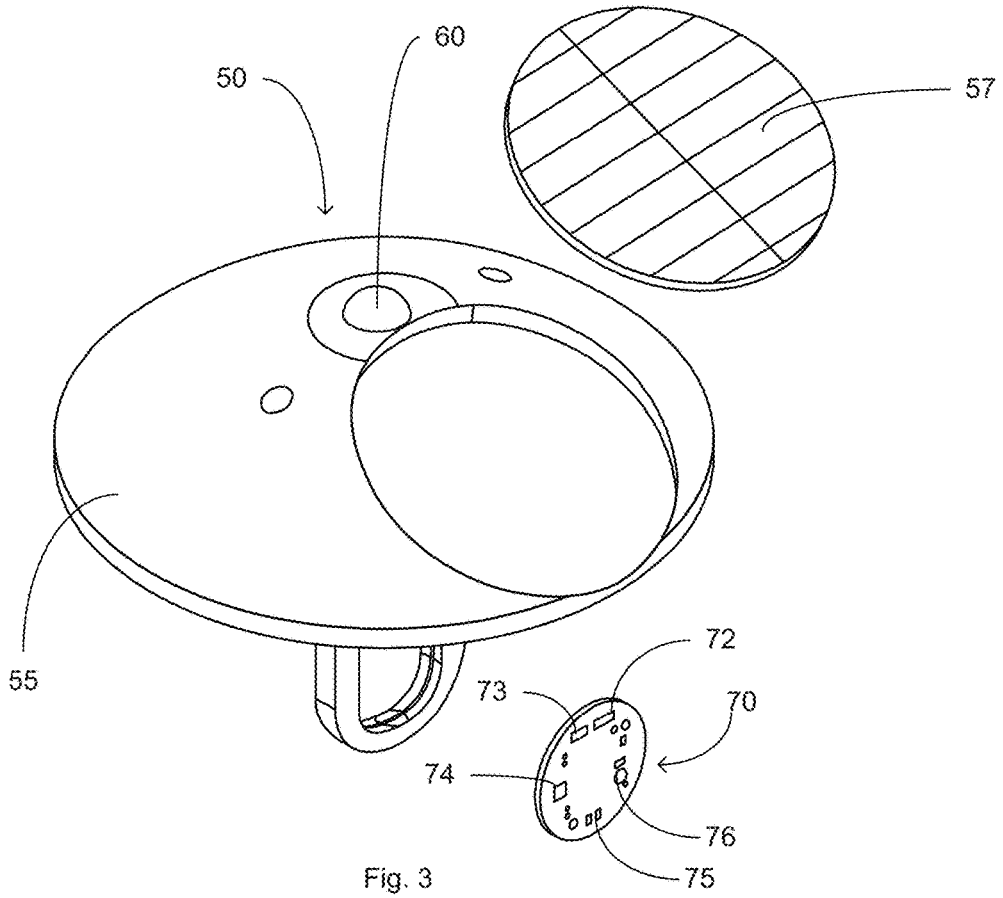
FIG. 3 is a top view of the roof cap of the present invention.
Figure 4:
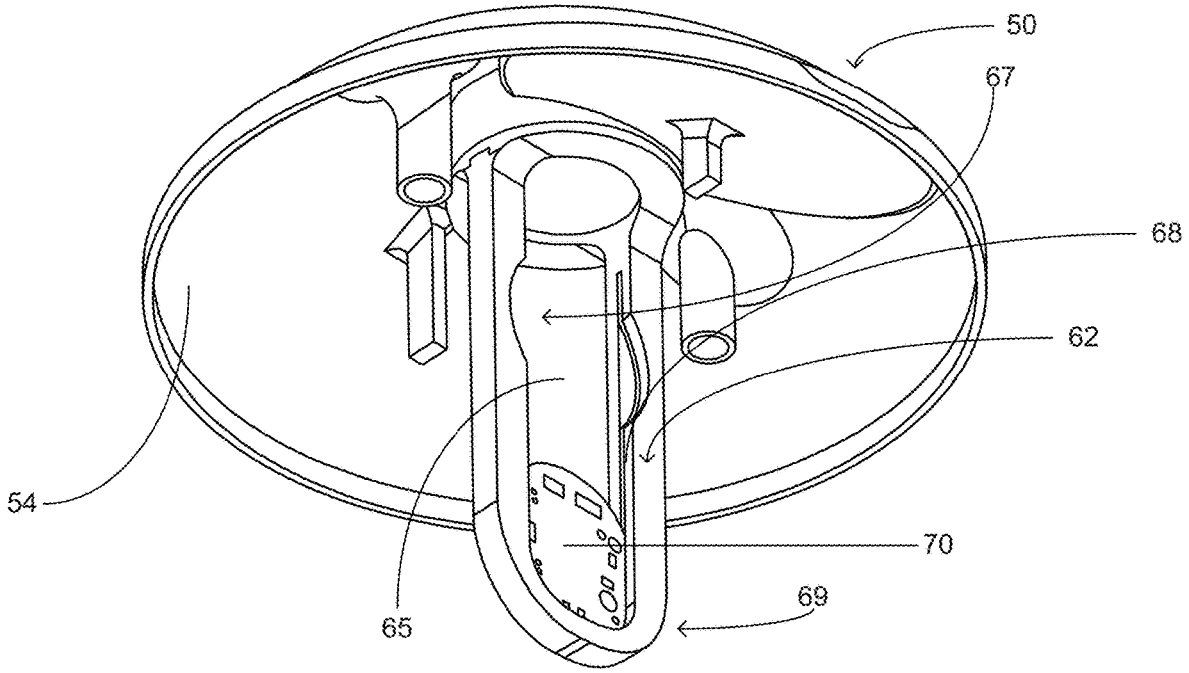
FIG. 4 is a bottom view of the roof cap of the present invention.

Referring in particular to FIGS. 3 and 4, the roof vent cap 50 is illustrated therein. Roof vent cap 50 includes shell 55 manufactured from a suitable durable material and is dome-shaped so as to extend beyond roof vent riser tube 15. It should be understood that the shell 55 could be manufactured in various alternate shapes and sizes in order to accomplish the desired task of providing cover for the roof vent riser tube 15. The roof vent cap 50 includes photovoltaic panel 57 secured thereto. Photovoltaic panel 57 is a conventional collection of photovoltaic cells that is electrically coupled to the detection-communication module 70 so as to provide power thereto. It is further contemplated within the present invention that the detection-communication module 70 be powered by alternate power sources such as but not limited to batteries either independently or in conjunction with the photovoltaic panel 57. The roof vent cap 50 is secured utilizing suitable durable techniques and it is contemplated within the scope of the present invention that the roof vent cap 50 could be secured in a fixed position or be rotatably secured. Employing a rotatably secured roof vent cap 50 would allow adjustment so as to optimize the exposure of the photovoltaic panel 57 to the sun. Located at the top of the shell 55 is proximity sensor 60. Proximity sensor 60 is a conventional photo sensor, such as but not limited to infrared. The proximity sensor 60 is operably coupled to the detection-communication module 70 utilizing suitable techniques. The proximity sensor 60 provides monitoring of an area proximate the roof vent 10 and is contemplated to be utilized for security monitoring and the like within the scope of the present invention.

The detection—communication module 70 is suspendedly secured within the passage 20 of the roof vent riser tube 15 utilizing bracket 62. Bracket 62 is integrally formed with the bottom surface 54 of shell 55. Bracket 62 is elongated in shape having central void 65 configured to receive detection—communication module 70 and releasably secure therein. Bracket 62 includes opening 67 being of suitable size so as to accommodate detection—communication module 70 therein to allow the detection—communication module 70 to be slidably engaged with grooves 68 and as such be moved to lower end 69 of the bracket 62. It is contemplated within the scope of the present invention that the bracket 62 could be formed in numerous alternate shapes in order to accommodate a detection—communication module 70 having a different shape than what is illustrated herein. It should be understood by those skilled in the art that the detection—communication module 70 could be formed in various different shapes and sizes and as such a bracket 62 could be formed so as to suspendedly mount the detection—communication module 70 within the passage 20 of the roof vent riser tube 15

The detection-communication module 70 includes the necessary electronics to store, receive, transmit and manipulate data. The detection-communication module 70 is configured to provide various data measurements and transmit data signals to a remote server or other suitable computing device. The detection-communication module 70 is a conventional integrated circuit board having a plurality of sensors and transmitters thereon. The detection-communication module 70 includes humidity sensor 72. The humidity sensor 72 functions to detect the moisture in the air present within the hollow passage 20 as well as the humidity of the environmental air adjacent to the roof vent 10. In order to accomplish the latter, the fan 5 is placed in its second mode, as further described herein for sufficient time to draw environmental air into hollow passage 20 to allow measurement of the relative humidity. Humidity sensor 72 is a conventional humidity sensor that detects moisture changes that alters the electrical currents or temperature in the air. It is contemplated within the scope of the present invention that the humidity sensor 72 could be manufactured as a capacitive, digital or resistive humidity sensor. The humidity sensor 72 of the present invention is calibrated to measure moisture in the low parts-per-million range in order to provide early detection of moisture and potential problems with exemplary roof 99. Humidity sensor 72 is communicably coupled to transceiver 75 in order to provide data as will be further discussed herein. Sensors 73, 74 are additionally present on the detection-communication module 70. Sensors 73,74 are barometric pressure sensors and vibration sensors respectively. Sensors 73,74 are conventional barometric and vibration sensors and are communicably coupled to transceiver 75 so as to provide additional data such as storm detection or structural movement to a user of the roof moisture detection and removal system 100. The transceiver 75 is a conventional wireless transceiver having the necessary electronics to send and receive data signals. The transceiver 75 is operable to transmit the data signals collected by the humidity sensor 72 and sensors 73,74 to a remote computing device via conventional wireless communication protocols. As will be further discussed herein, each transceiver 75 is assigned a specific identifier such as but not limited to an IP address so as to provide a unique identifier associated with a location of each roof vent 10.

Referring in particular to FIG. 1, a fan 5 is mounted above or within hollow passage 20 of roof vent riser tube 15. The fan 5 is a conventional fan or bidirectional electric fan electrically coupled to the detection-communications module 70. The fan 5 functions in a first mode and a second mode. In a first mode, the fan 5 functions to draw air from the void 35 which has been fed by airflow extension tubes 40 and draws the air upwards across humidity sensor 72 towards upper end 16 and expels the air from the roof vent 10. The aforementioned assists in the moisture detection process as well as removal of any moisture that could be accumulated proximate an installed roof vent 10. In its second mode, the fan 5 functions to push external air into the void 35 and further into the space 3 intermediate the roof membrane 98 and the additional layers 2 of the exemplary roof 99. In the second mode, the fan 5 provides a positive air pressure in the area 9 adjacent the roof vent 10. As the fan 5 continues in its second mode of operation, the positive air pressure being provided by the fan 5 disposed within the roof vent 10 forces the air trapped in space 3 to be directed to adjacent roof vents 10 so as to be discharged therefrom. Further, the increased air volume will result in the expansion of space 3 allowing more water, if present, to be converted to a vapor state within space 3 so as to be more efficiently evacuated. It is further contemplated within the scope of the present invention that the detection-communications module 70 be equipped with a conventional pressure sensor 76 so as to monitor the pressure within the roof vent 10. Ensuing the achievement of a desired pressure, the detection-communications module 70 will halt operation of the fan 5 in its second mode and return the fan 5 to its first mode in order to draw the air present in the space 3 proximate the roof vent 10 and expel therefrom and as such provide removal of moisture associated therewith. It is contemplated within the scope of the present invention that a single roof vent 10 having a fan disposed therein could alternate intermediate the aforementioned first mode and second mode so as to assist in the evacuation of moisture in the space 3. Furthermore, it is contemplated within the scope of the present invention that an exemplary roof 99 having a plurality of roof vents 10 with fans 5 could operate in the second mode of the fan 5 so as to move air to adjacent roof vents 10 for evacuation thereof. Operation in the second mode of the fan could be either controlled by a measured pressure as described herein or in a continuous manner wherein the fan 5 continuously pushes air outward from the roof vent into the adjacent space 3 to be expelled by proximate roof vents 10. Utilization of the fan in the aforementioned first mode and second mode expedites the drying process and further provides the ability to more quickly obtain humidity data. It should be understood that within the scope of the present invention the roof vent 10 could be provided with or without a fan 5. It should be understood by those skilled in the art that the pressure sensor 76 is further operable to monitor the pressure in space 3 so as to avoid a pressure therein that could cause damage to the roof membrane 98.

Figure 5:
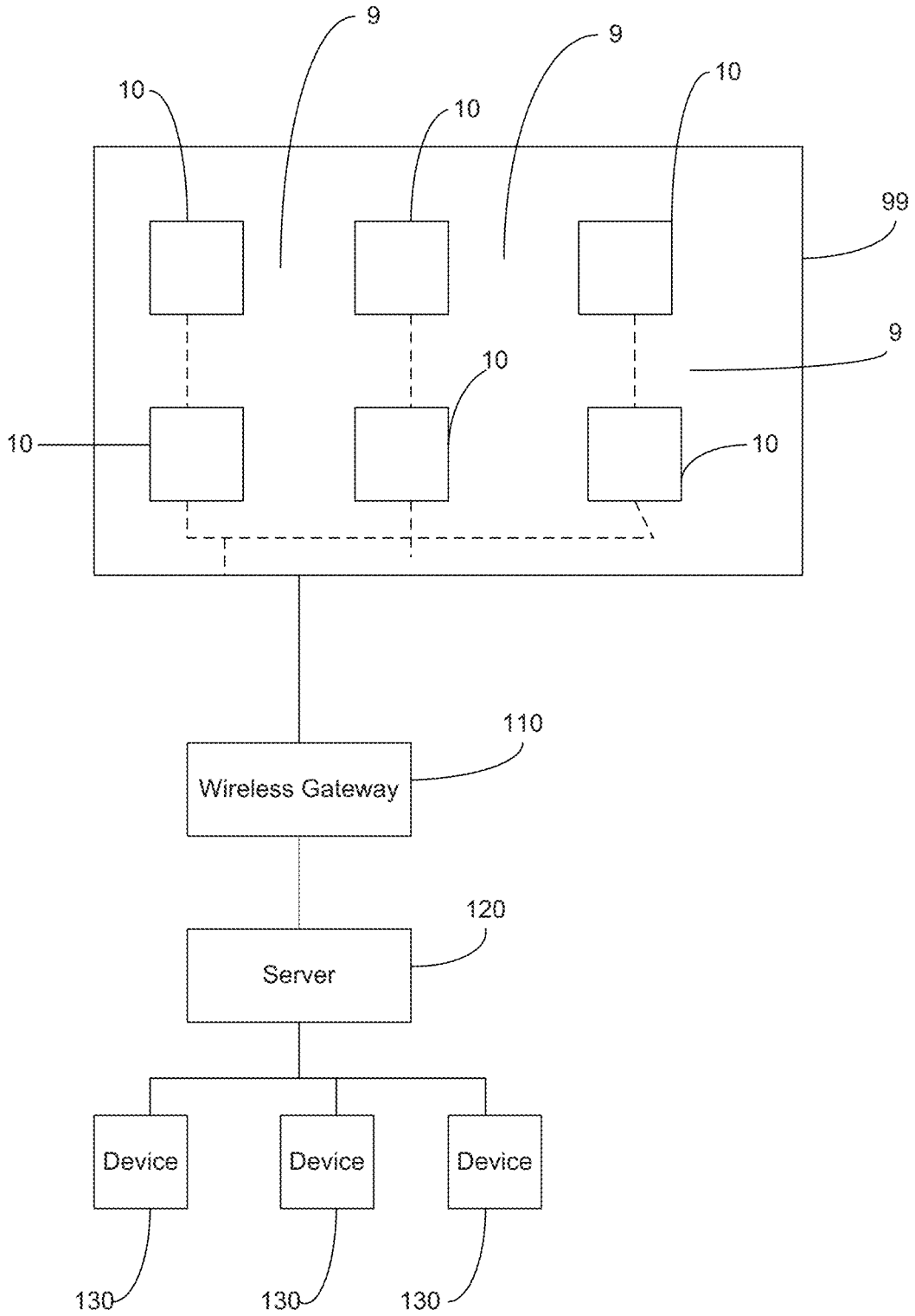
FIG. 5 is a block diagram of the operational components of the present invention.
Figure 6:
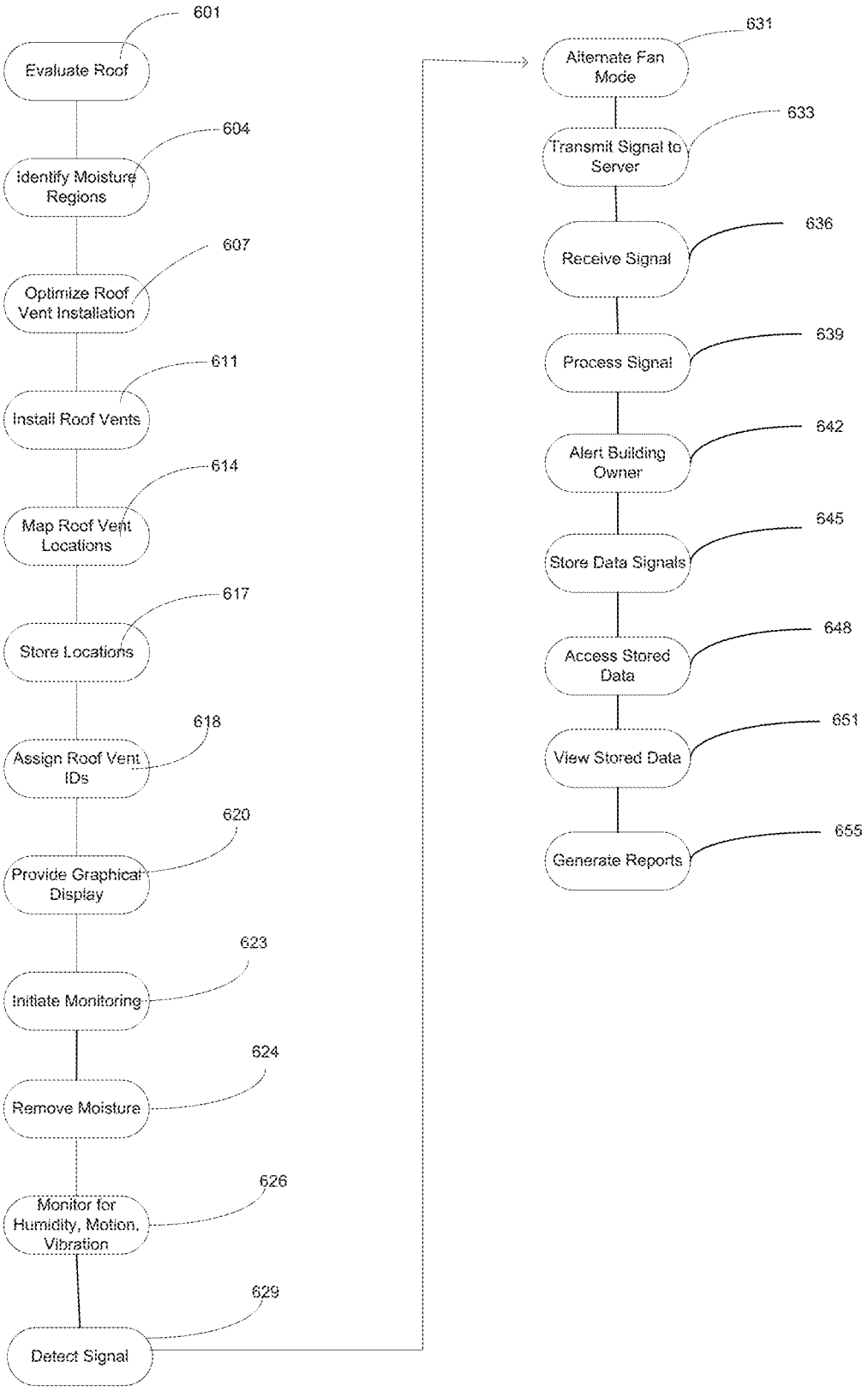
FIG. 6 is a flowchart of the steps of the method of the present invention.

Referring in particular to FIG. 5, a block diagram of the network schematic of the present invention is illustrated therein. The roof vents 10 are deployed on exemplary roof 99 wherein as described herein the roof vents 10 are equipped with the detection-communication module 70. The transceivers of the detection-communication module 70 for each roof vent are wirelessly coupled to a gateway 110 utilizing conventional wireless communication protocols. The gateway 110 is a conventional wireless gateway that is operably coupled to the Internet in order to communicate with server 120. The server 120 of the roof moisture detection and removal system 100 is a conventional computer server having software loaded thereon and the necessary electronics to receive, store, transmit and manipulate data. Data signals from the transceivers 75 are provided to the server 120 for storage and other tasks such as but not limited to report generation. The server 120 is communicably coupled to a plurality of additional computing devices 130. It is contemplated within the scope of the present invention that the server 120 can either provide data to or be accessed by the additional computing devices 130. The additional computing devices 130 are conventional devices such as but not limited to smart phones or personal computers Now referring in particular to FIG. 6, the method of the roof moisture detection and removal system 100 is outlined therein. Step 601, the roof 99 is evaluated utilizing techniques such as but not limited to infrared inspection wherein regions of the roof 99 are mapped via a computer aided drawing. In step 604, ensuing evaluation of the roof mapping the regions containing moisture or those determined for the potential to collect moisture are identified. Step 607, optimization of the roof vent installation location is determined and core samples are taken in order to establish a baseline moisture content for the roof vent installation locations. In step 611, the roof vents 10 are installed in the identified installation locations. Step 614, the installed locations of the roof vents 10 are mapped for the roof 99 and in step 617 the locations for the installed roof vents 10 are communicated to and stored on server 120. In step 618, the roof vents 10 are assigned a unique identifier wherein all data transmitted therefrom includes the unique identifier so as to determine the location of the data signals. Step 620, a graphical display of the roof vent 10 locations are made available to a user on a preferred computing device 130. In step 623, the roof vents 10 are activated so as to initiate the monitoring process. In step 624, the roof vents 10 commence removing moisture from exemplary roof 99. Step 626, each roof vent 10 installed on the roof 99 monitors for humidity, motion and vibration. Step 629, at least one of the aforementioned monitored parameters is detected by the detection-communication module 70. In step 631, the fan 5 is placed in either its first mode of operation or its second mode of operation as defined herein. It is contemplated based on the humidity detected that the fan 5 is placed in either its first mode, its second mode or alternated therebetween in order to efficiently remove moisture from roof 99

In step 633, the transceiver 75 of the detection-communication module 70 transmits the data signal, which is relayed to the server 120 by the gateway 110. Step 636, the server 120 receives the transmitted data signal. In step 639, the server 120 processes the data signal to determine if the parameter exceeds either the baseline or other programmed limit specified for that roof vent 10. Ensuing determination that the data signal received has exceeded the baseline or programmed limit for the parameter and roof vent 10, in step 642 an alert message is transmitted. The alert message is delivered via conventional communication protocols such as but not limited to SMS text or email to a person such as but not limited to a building owner or maintenance department. In step 645, the server 120 continuously stores data signals received from the roof vents 10 for the roof 99. Step 648, at desired intervals, an entity such as but not limited to a building owner or maintenance department accesses the stored data for a particular roof. In step 651, the stored data for a particular roof 99 is retrieved and viewed by the aforementioned entity. Step 655, the server facilitates the generation of historical data reports for an inputted timeline wherein the historical data reports include data such as but not limited to historical data charts for each measured parameter recorded by the detection-communication module 70 of each roof vent 10. It should be understood that the roof moisture detection and removal system 100 could utilize as few as one roof vent 10 to execute the procedures described herein or include a plurality of roof vents 10.

Figure 7:
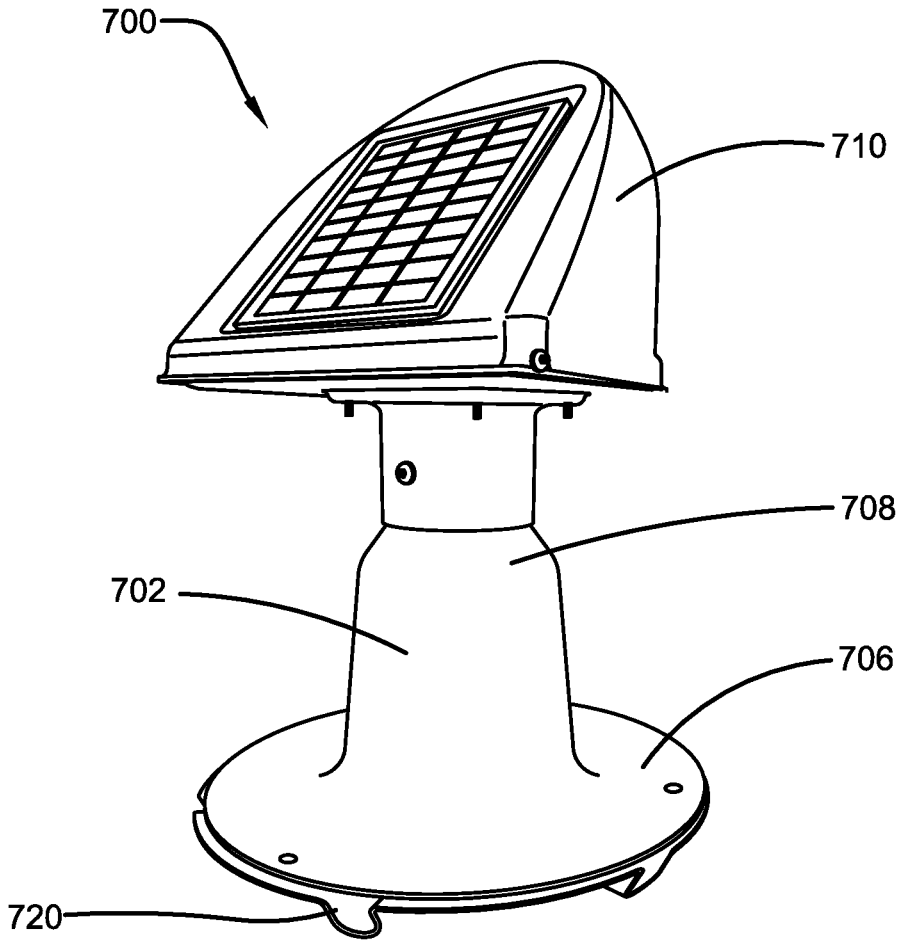
FIG. 7 is a perspective view of a roof vent assembly according to some embodiments of this invention.
Figure 8:
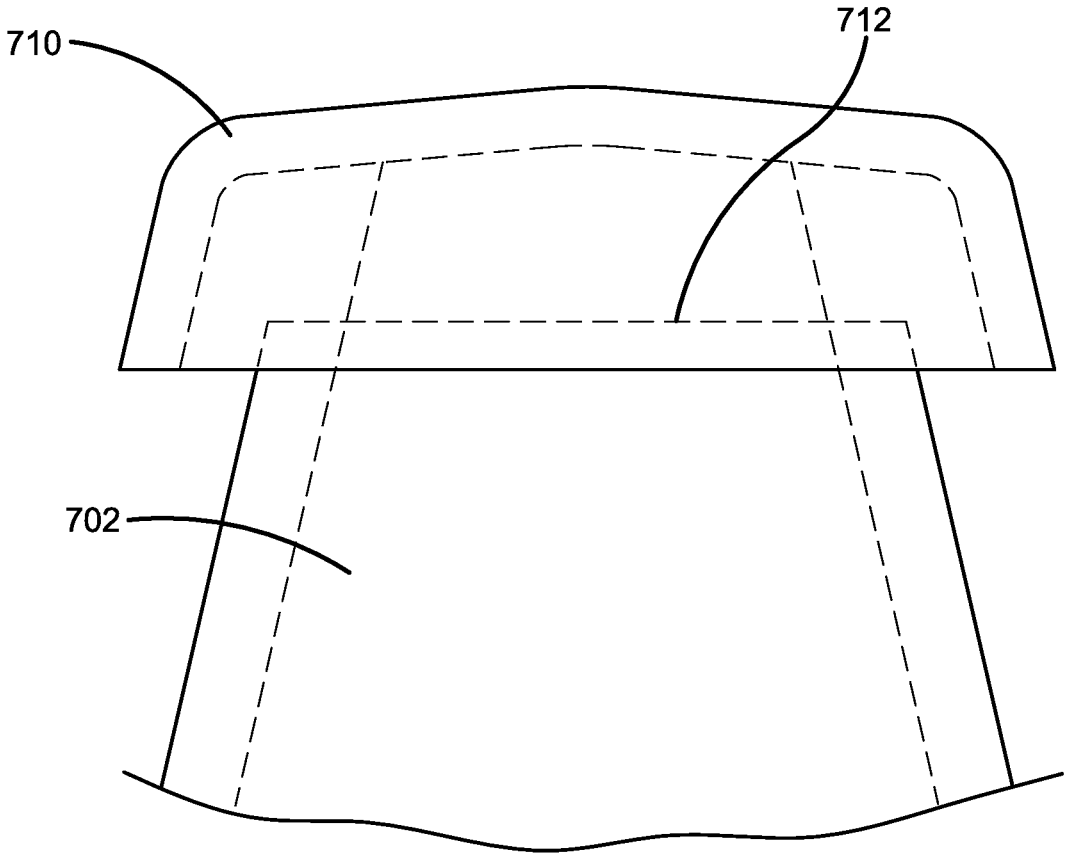
FIG. 8 is a side view of an alternate vent cap.
Figure 10:
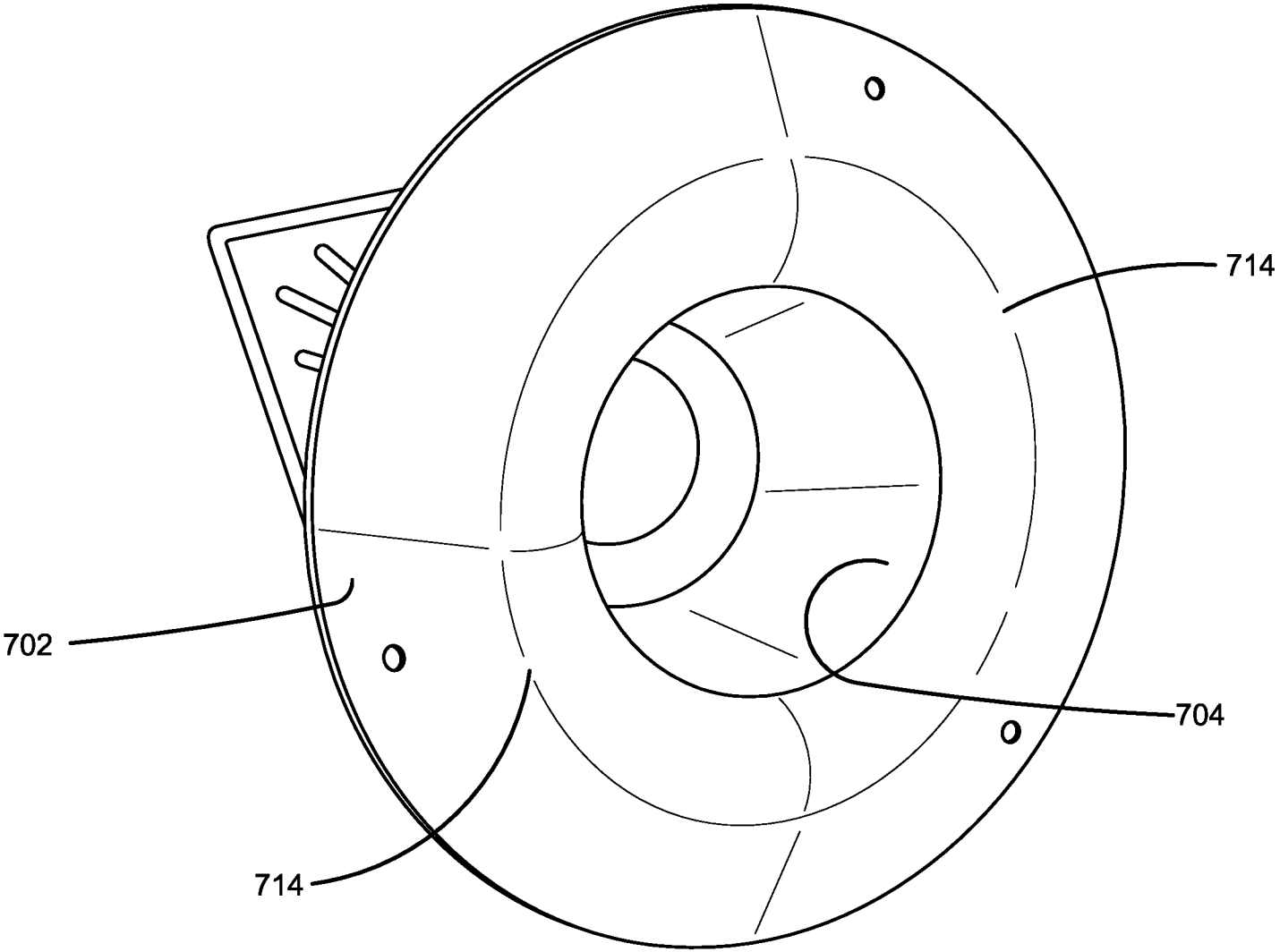
FIG. 10 is a bottom perspective view of a vent tube.

FIG. 7 shows another embodiment, a roof vent assembly 700, which may be similar in some ways to previously described embodiments. Roof vent assembly 700 may include a vent tube 702 having a hollow passage 704 (FIG. 10) extending between a lower end 706 and an upper end 708, a vent cap 710 couplable to the upper end 708 of the vent tube 702 and an air plate 720 couplable to the lower end 706 of the vent tube 702, as shown. As shown in FIG. 10, the lower end of the vent tube 702 may have a contact surface 714 used for a purpose described further below. In some embodiments, like FIG. 7, the vent cap 710 may be similar to the vent caps described above including detection-communications components. In other embodiments such as shown in FIG. 8, however, the vent cap 710 may simply be a lid that includes none of the electronic components described above. It may, for example, include only downward extending passages 712 whereby air that exits up through the vent tube 702 may pass out of the roof vent assembly. Such vent caps are well known to those of skill in the art and therefore will not be described further here. In some embodiments a fan 5 (FIG. 1) may be used with the roof vent assembly 700. In other embodiments, a fan 5 is not used.

Figure 9:
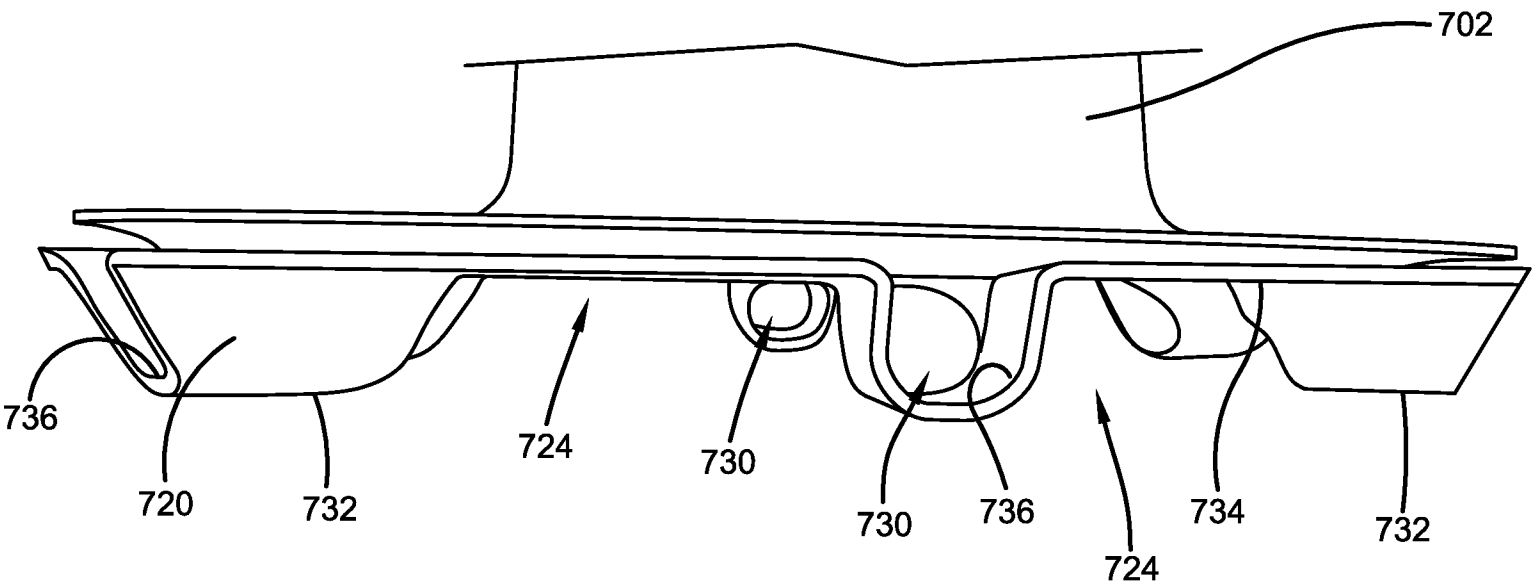
FIG. 9 is a side view of the bottom portion of the roof vent assembly shown in FIG. 7.
Figure 11:
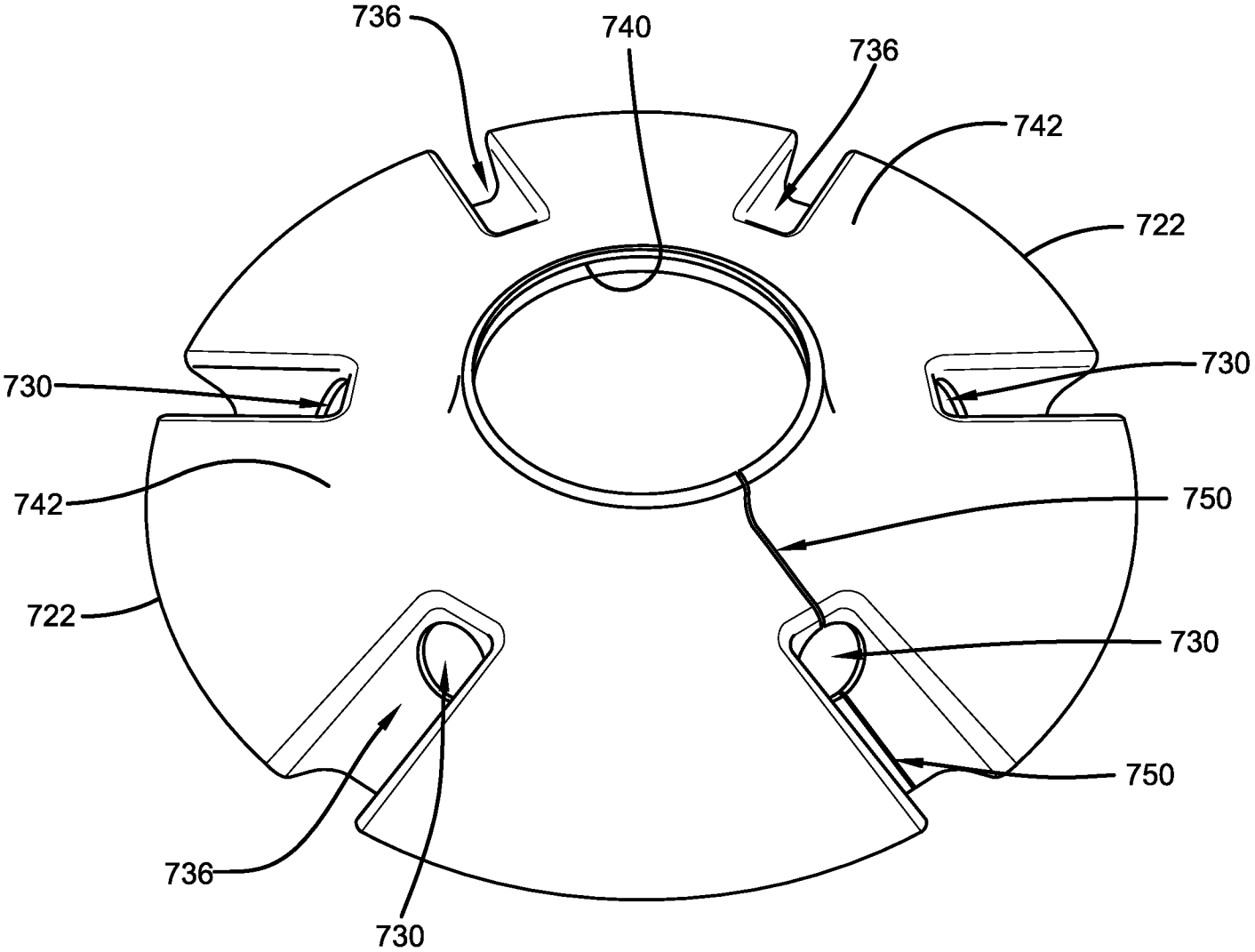
FIG. 11 is a top perspective view of an air plate.
Figure 12:
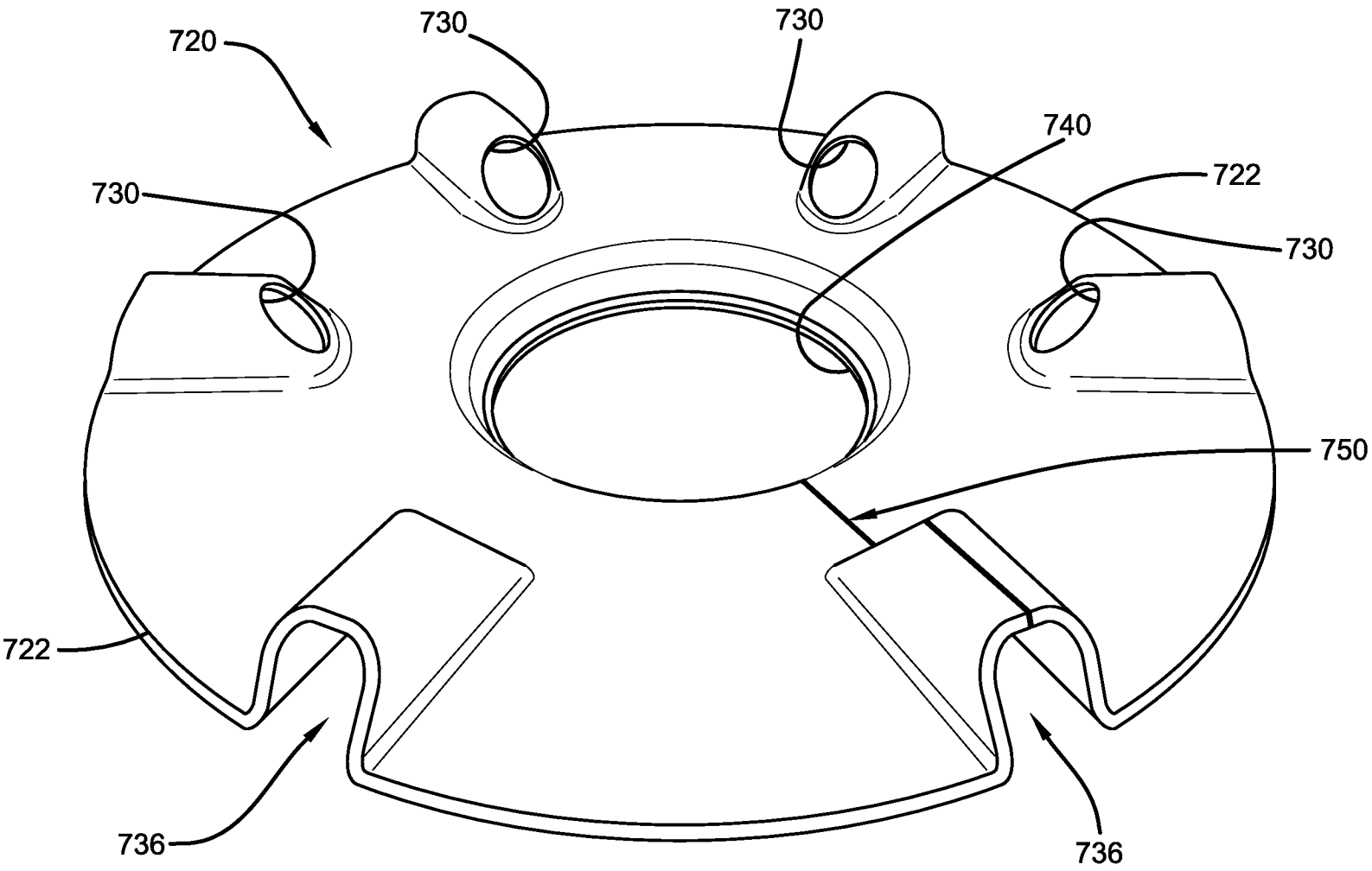
FIG. 12 is a bottom perspective view of an air plate.

With reference now to FIGS. 9, 11-12, the air plate 720 may have a periphery 722, an internal air plenum 724 and one or more apertures 730, six shown, that communicate with the internal air plenum 724. The air plate 720 may have a lower surface 732 and an upper surface 734 defining between them the internal air plenum 724. The internal air plenum is shown with reference 35 in FIG. 1. In some embodiments, shown, the air plate 720 is substantially ring shaped and has a central opening 740. The central opening 740 may be used to communicate the internal air plenum 724 with the hollow passage 704 in the vent tube 702. The apertures 730 may be of any design chosen with the sound judgment of a person of skill in the art. For the embodiments shown, the apertures 730 are inset from the periphery 722 at the inside end of a channel 736. The apertures 730 and channels 736 may be positioned in any manner chosen with the sound judgment of a person of skill in the art. For the embodiments shown, the channels 736 are arranged evenly around the circumference of the air plate 720. Thus, it can properly be said that in some embodiments there are apertures 730 and/or channels 736 positioned on opposite sides of the air plate 720. The channels 736 may serve as connection channels as will be described further below.

The roof vent assembly 700 of FIG. 7 may also include one or more airflow extension members 40 shown in FIG. 2. The airflow extension members 40 create external air plenums shown with reference 3 in FIG. 1 and include the volume outside the periphery of the air plate 720, under the roof membrane 98, above the internal roof 99, near the airflow extension members 40 and radially external to the airflow extension members 40. In some embodiments, shown, the airflow extension members 40 have an opening along their length making them airflow extension tubes. In this case, the external air plenums also include the air volume within the tube(s) 40. With references to FIGS. 2, 7 and 11-12, a first end of an airflow extension tube 40 may be couplable to an aperture 730 while the second, opposite, end may extend outward beyond the periphery 722 of the air plate 720. In one embodiment, the channel 736 may receive the first end of the airflow extension tube 40 to simplify the coupling; making the channels 736 a connection channel. If the air plate 720 has more than one aperture 730, any number of the apertures 730 may be coupled to an airflow extension tube 40. In some embodiments, all the apertures 730 may be coupled to an airflow extension tube 40. If the airflow extension member 40 is not a tube, it is not necessary that an aperture be used with the channel 736. If the air plate 720 is ring shaped, the airflow extension members 40 may extend radially outward beyond the periphery 722. The amount of extension beyond the periphery 722 can be any amount chosen with the sound judgment of a person of skill in the art. The greater the extension of the airflow extension tube 40, the greater the external air plenum volume resulting in greater removed moisture, faster removed moisture and greater roof volume treated. In some embodiments, the air flow extension members 40 extend at least 6 inches beyond the periphery 722; in other embodiments at least 12 inches; in other embodiments at least 24 inches; in other embodiments at least 36 inches; in yet other embodiments as much as 120 inches.

With reference to FIGS. 11-12, in some embodiments the air plate 720 may have a split seam 750 that extends between the periphery 722 and the central opening 740. The split seam 750 enables the air plate 720 to be inserted within an opening smaller than the outside diameter of the air plate 720. In some embodiments, the air plate 750 may have a contact surface 742 (FIG. 11). Contact surface 742 may, in some embodiments, engage contact surface 714 of the vent tube 702 (FIG. 10) when the air plate 720 is coupled to the vent tube 702. In some embodiments, the roof vent assembly 700 is configured to receive a roof membrane 98 (FIG. 1) between the contact surfaces 714, 742 when the roof vent assembly 700 is installed on a roof.

The roof vent assembly 700 may be used as described above. It may be operable to draw air from the external air plenum 3 (including through the airflow extension member 40 if it is an airflow extension tube), into the internal air plenum 724, 35, through the hollow passage 704 of the vent tube 702, out through the upper end 708 of the vent tube 702 and out of the vent cap 710 to atmosphere. If a fan is used, this airflow may be forced airflow.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

Having thus described the invention, it is now claimed:

1. A roof vent assembly comprising:

a vent tube having a lower end, an upper end, and a hollow passage extending between the lower end and the upper end;

a vent cap coupled to the upper end of the vent tube;

an air plate coupled to the lower end of the vent tube and having: a periphery, an internal air plenum, and a first aperture that communicates with the internal air plenum;

a first airflow extension tube that has: a first end that is coupled to the first aperture; and a second end that extends outward beyond the periphery of the air plate to create a first external air plenum; and wherein the roof vent assembly is operable to draw air from the first external air plenum, into the internal air plenum, through the hollow passage of the vent tube and out through the upper end of the vent tube.

2. The roof vent assembly of claim 1 wherein:

the first aperture is positioned on a first side of the air plate;

the first airflow extension tube extends outward from the first aperture;

the air plate has a second aperture that: communicates with the internal air plenum; and is positioned on a second side of the air plate that is opposite the first side;

a second airflow extension tube has a first end that is coupled to the second aperture and a second end that extends outward beyond the periphery of the air plate to create a second external air plenum; and the roof vent assembly is operable to draw air from the second external air plenum, into the internal air plenum, through the hollow passage of the vent tube and out through the upper end of the vent tube.

3. The roof vent assembly of claim 2 wherein:

the first airflow extension tube extends outward beyond the periphery of the air plate by at least 12 inches; and the second airflow extension tube extends outward beyond the periphery of the air plate by at least 12 inches.

4. The roof vent assembly of claim 1 wherein:

the air plate has a lower surface and an upper surface defining between them the internal air plenum.

5. The roof vent assembly of claim 1 wherein the air plate:

is substantially ring shaped with a central opening that communicates the internal air plenum with the hollow passage in the vent tube.

6. The roof vent assembly of claim 5 wherein the air plate:

has a split seam that extends between the periphery and the central opening.

7. The roof vent assembly of claim 6 wherein:

the lower end of the vent tube defines a first contact surface;

the air plate defines a second contact surface; and the roof vent assembly is configured to receive an associated roof membrane between the first and second contact surfaces when the roof vent assembly is installed on an associated roof.

8. The roof vent assembly of claim 1 further comprising:

a fan that is supported to the vent tube and operable to force air from the first external air plenum, into the internal air plenum, through the hollow passage of the vent tube and out through the upper end of the vent tube.

9. The roof vent assembly of claim 1 further comprising:

a detection-communications module comprising an integrated circuit board having a plurality of sensors.

10. A roof vent assembly comprising:

a vent tube having a lower end, an upper end and a hollow passage extending between the lower end and the upper end;

a vent cap coupled to the upper end of the vent tube;

an air plate coupled to the lower end of the vent tube and having: a periphery; an internal air plenum; and a first connection channel;

a first airflow extension member that has: a first end that is coupled to the first connection channel; and a second end that extends outward beyond the periphery of the air plate to create a first external air plenum; and wherein the roof vent assembly is operable to draw air from the first external air plenum, into the internal air plenum, through the hollow passage of the vent tube and out through the upper end of the vent tube.

11. The roof vent assembly of claim 10 wherein:

the first connection channel is positioned on a first side of the air plate;

the first airflow extension member extends outward from the first connection channel;

the air plate has a second connection channel that is positioned on a second side of the air plate that is opposite the first side;

a second airflow extension member has a first end that is coupled to the second connection channel and a second end that extends outward beyond the periphery of the air plate to create a second external air plenum; and the roof vent assembly is operable to draw air from the second external air plenum, into the internal air plenum, through the hollow passage of the vent tube and out through the upper end of the vent tube.

12. The roof vent assembly of claim 11 wherein:

the first airflow extension member extends outward beyond the periphery of the air plate by at least 12 inches; and the second airflow extension member extends outward beyond the periphery of the air plate by at least 12 inches.

13. The roof vent assembly of claim 10 wherein:

the air plate has a lower surface and an upper surface defining between them the internal air plenum.

14. The roof vent assembly of claim 10 wherein the air plate:

is substantially ring shaped with a central opening that communicates the internal air plenum with the hollow passage in the vent tube.

15. The roof vent assembly of claim 14 wherein the air plate:

has a split seam that extends between the periphery and the central opening.

16. The roof vent assembly of claim 15 wherein:

the lower end of the vent tube defines a first contact surface;

the air plate defines a second contact surface; and the roof vent assembly is configured to receive an associated roof membrane between the first and second contact surfaces when the roof vent assembly is installed on an associated roof.

17. The roof vent assembly of claim 10 further comprising:

a fan that is supported to the vent tube and operable to force air from the first external air plenum, into the internal air plenum, through the hollow passage of the vent tube and out through the upper end of the vent tube.

18. A roof vent assembly comprising:

a vent tube having a lower end, and upper end, and a hollow passage extending between the lower end and the upper end;

a vent cap coupled to the upper end of the vent tube;

an air plate that: has a periphery; has a lower surface and an upper surface defining between them an internal air plenum; is substantially ring shaped with a central opening that communicates the internal air plenum with the hollow passage in the vent tube; has a split seam that extends between the periphery and the central opening; has a first aperture on a first side that communicates with the internal air plenum; and has a second aperture on a second side opposite the first side that communicates with the internal air plenum;

a first airflow extension tube that has: a first end that is coupled to the first aperture; and a second end that extends radially outward beyond the periphery of the air plate by at least 12 inches to create a first external air plenum; and a second airflow extension tube that has: a first end that is coupled to the second aperture; and a second end that extends radially outward beyond the periphery of the air plate by at least 12 inches to create a second external air plenum;

wherein the roof vent assembly is operable to draw air from the first and the second external air plenums into the internal air plenum, through the hollow passage of the vent tube and out through the upper end of the vent tube.

19. The roof vent assembly of claim 18 wherein:

the lower end of the vent tube defines a first contact surface;

the air plate defines a second contact surface; and the roof vent assembly is configured to receive an associated roof membrane between the first and second contact surfaces when the roof vent assembly is installed on an associated roof.

* * * * *